United States Patent [19]

Douglas

[11] Patent Number: 4,808,132

[45] Date of Patent: Feb. 28, 1989

[54] MARINE DRIVE APPARATUS

[76] Inventor: Geoffrey B. Douglas, P.O. Box 215, Airlie Beach, Queensland, Australia

[21] Appl. No.: 97,791

[22] Filed: Sep. 16, 1987

[30] Foreign Application Priority Data

Sep. 19, 1986 [AU] Australia ..... 62958/86

[51] Int. Cl.[4] ..... B63H 5/14

[52] U.S. Cl. ..... 440/66; 114/166

[58] Field of Search ..... 114/163, 166; 440/66–71, 40, 41, 42

[56] References Cited

U.S. PATENT DOCUMENTS

| | | | |
|---|---|---|---|
| 1,543,082 | 6/1925 | Harley | 440/70 X |
| 2,328,041 | 8/1943 | Wellons | 114/166 X |
| 2,896,565 | 7/1959 | Stevens | 114/166 X |
| 3,138,922 | 6/1964 | Englehart et al. | 440/41 X |
| 3,336,752 | 8/1967 | Smith | 440/41 X |
| 3,946,556 | 3/1976 | Catterfeld | 440/41 X |

*Primary Examiner*—Sherman D. Basinger

*Attorney, Agent, or Firm*—Leydig, Voit & Mayer

[57] ABSTRACT

A marine drive apparatus including a shroud channel selectively rotatable to direct the water produced by a rotatable propeller so as to provide reversing and steering of a marine craft. The shroud channel has spaced side walls joined by a roof portion, the side walls being used to deflect the water flow so as to produce a steering thrust and the roof portion being movable aft of the propeller to deflect the water flow and produce a reverse thrust.

20 Claims, 2 Drawing Sheets

MARINE DRIVE APPARATUS

BACKGROUND

The present invention relates to marine drive apparatus and is directed to achieving reverse thrust as well as steerage.

Conventionally, marine drive apparatus of the shaft and pitched propeller type achieve reversibility by complex mechanisms reversing the rotation of the propeller. A durable apparatus of this type may be of undesirable bulk and weight for certain applications. Steerage requires a separate rudder means.

SUMMARY OF THE INVENTION

It is an object of the present invention to provide reversible, steerable thrust by a relatively simple, light weight and durable means.

According to the invention there is provided a marine drive apparatus including a reversing and steering channel at least partly shrouding a rotatable propeller so as to direct the flow of water produced by said propeller, said channel in its forward configuration having spaced side walls joined by a roof portion and being selectively rotatable about a first substantially vertical axis to provide steerage and a second substantially horizontal axis to move said roof portion aft of said propeller such that said channel can intercept and deflect said flow, thereby to provide reverse thrust.

The channel is substantially U-shaped in crosssection and positioned such that in its forward configuration lower portions of its sidewalls extend beneath the water surface on either side of the propeller to act as steering fins while the roof portion rides clear of the water.

Preferably said roof portion includes inwardly directed deflection means located at least at its aft end for providing increased reverse thrust.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
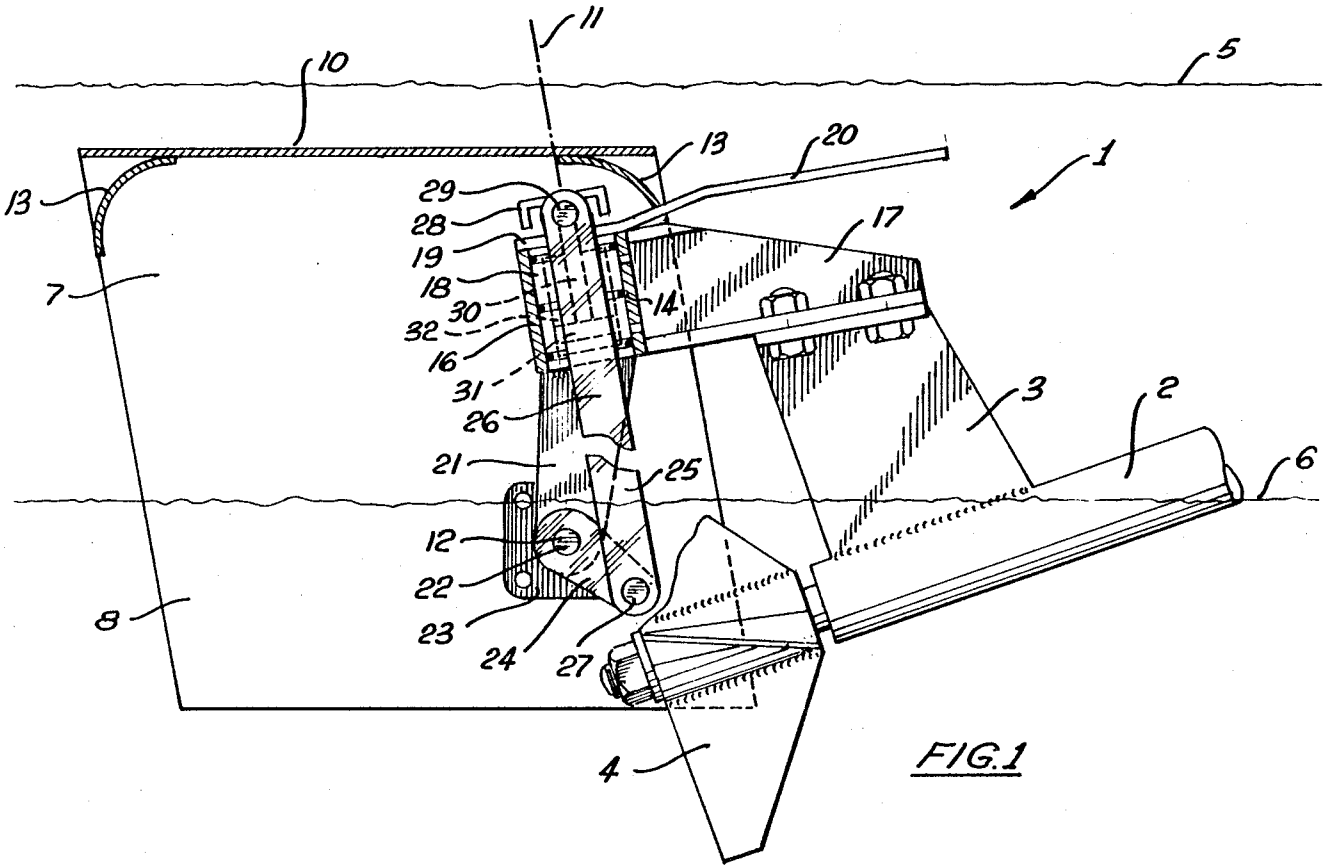
FIG. 1 is a part sectioned side elevation of a marine drive apparatus according to the invention, showing the channel positioned for ahead propulsion.

Referring to the drawings, the marine drive apparatus 1 is shown attached to a propeller shaft housing 2 by a wedge-shaped mounting bracket 3. The propeller 4 may be of the surface-piercing type such that the vessel operates between a low speed water level approximately at 5 and a high speed water level approximately at 6.

The drive includes a channel 7 having spaced side walls 8 and 9 joined by a roof portion 10. The channel 7 is selectively rotatable about a first, substantially vertical axis 11 and a second substantially horizontal axis 12 in a manner to be described hereinafter.

Figure 3:
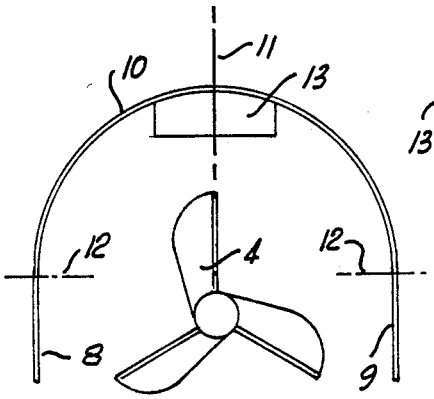
FIG. 3 is a forward looking end view of the apparatus shown in FIG. 2.
Figure 5:
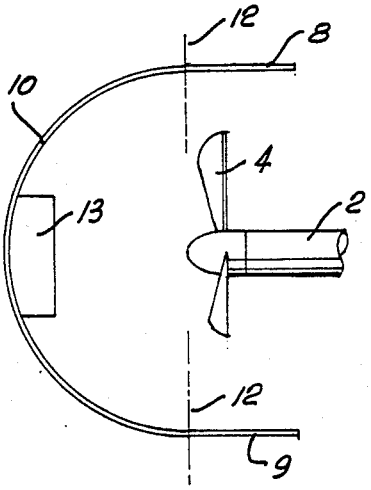
FIG. 5 is a plan view of the astern propulsion configuration illustrated in FIG. 4.
Figure 4:
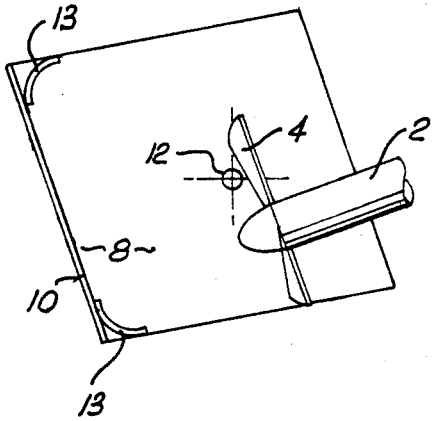
FIG. 4 is a view similar to FIGS. 1 and 2 but illustrating the channel rotated to its position for providing reverse thrust.

The channel 7 partly shrouds the propeller 4 so as to direct the flow of water and control the direction of motion. Rotation about the substantially vertical axis 11 provides steerage while rotation about the substantially horizontal axis provides reverse thrust by moving the channel from the forward configuration shown in FIGS. 1 to 3 to the reverse configuration shown in FIGS. 4 and 5. In the reverse configuration it can be seen that the roof portion 10 has been moved to a position aft of the propeller 4 such that the channel 7 can intercept and deflect the flow and provide the required reverse thrust. The provision of inwardly directed deflection vanes 12 assists in diverting the flow of water and increasing the reverse thrust.

The desired channel rotation about the two axes can be achieved by any suitable means. One preferred form is illustrated somewhat schematically in FIG. 1.

In this embodiment, the drive is supported by a central bearing sleeve 16 rigidly secured to the mounting bracket 3 by a rearwardly cantilevered support arm 17. Rotatably mounted within the bearing sleeve 16 and coaxial with the substantially vertical steering axis 11 is a cyclindrical rudder post 18 rigidly connected at its top end with a transverse support beam 19. A steering arm 20 extends forwardly from the support beam 19. Conventional steering means attached to the steering arm will then rotate the transverse support beam about the axis 11.

Each end of the transverse support beam 19 is rigidly connected to a downwardly extending channel pivot arm 21. The lower end of each pivot arm 21 is pivotably engaged with a pin 22 rigidly secured to the channel side wall 8 by bracket 23.

Figure 2:
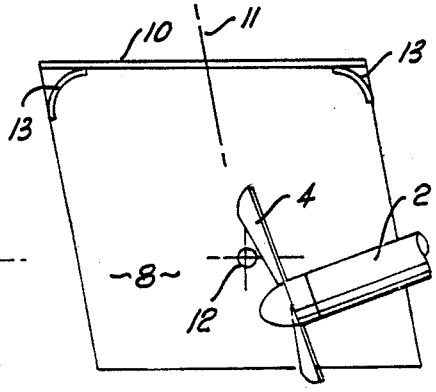
FIG. 2 is a schematic view of the channel configuration shown in FIG. 1.

It will be appreciated that FIG. 1 illustrates the port pivot arm 21 engaging the port channel side wall 8. An unseen but symmetrically identical configuration appears on the starboard side of the support beam 19 such that the pair of coaxial pivot pins 22 define the substantially horizontal axis 12.

Each channel side wall bracket 23 also carries a rigid crank arm 24. A port tilt link 25 and a starboard tilt link 26 are each pivotably engaged with their respective crank arms by coaxial pivot pins 27. The crank arms may be replaced with pivot pins 27 connected directly to the channel in the same manner as pivot pins 22.

The upper end of each tilt link is connected to a cross bar 28 by hinge pins 29. The centre of the cross bar is connected with a piston rod 30 and piston 31 which slides in a cylinder 32 defined by the inner surface of the rotatable rudder post 18. Hydraulic fluid is supplied by conventional means to the required opposite sides of the piston 31 via valving ports (not shown) through the walls of the bearing sleeve 16 and rudder post 18. Three O-ring seals 14 are respectively located between the central bearing sleeve 16 and the cylindrical rudder post 18 at the centre and opposite ends of the rudder post at shown. The seals separate the flow of hydraulic fluid through the ports respectively located between the three seals.

Actuation of the piston 31 raises or lowers the cross bar 28 which in turn moves the tilt links and rotates the channel as previously described about its substantially horizontal axis 12. This rotation is obtained without interference with the steering function achieved by rotation about the substantially vertical axis 11. This axis may be vertical or suitably inclined as shown.

Although the invention has been described with reference to a specific example it will be appreciated that the invention may be embodied in other forms within the scope of the appended claims.

I claim:

1. According to the invention there is provided a marine drive apparatus including a reversing and steering channel at least partly shrouding a rotatable propeller so as to direct the flow of water produced by said propeller, said channel in its forward configuration having spaced side walls joined by a roof portion and being selectively rotatable about a first substantially vertical axis to provide steerage and a second substantially horizontal axis to move said roof portion aft of said propeller such that said channel can intercept and deflect said flow, thereby to provide reverse thrust, said first axis being defined by a cylindrical rudder post rotatably mounted to a coaxial bearing adapted for rigid attachment to a water craft, said movement of said roof portion around said second axis being achieved by an hydraulically actuatable piston coaxial with said rudder post.

2. A marine drive apparatus according to claim 1 wherein said roof portion includes inwardly directed deflection means located at least at its aft end for providing increased reverse thrust.

3. A marine drive apparatus according to claim 2 wherein said deflection means comprises a pair of vanes respectively located at the forward and aft ends of said roof portion.

4. A marine drive apparatus according to claim 1 wherein said piston connects with a transverse cross bar pivotably connected at its opposite ends with respective links in turn pivotably connected at their opposite ends to coaxial pivot points on said channel spaced from said second axis.

5. A marine drive apparatus according to claim 1 wherein said first and second axes do not intersect.

6. A marine drive apparatus according to claim 1 wherein said first axis is vertical.

7. A marine drive apparatus according to claim 1 wherein said channel is substantially U-shaped in cross-section and positioned such that in its forward configuration the lower portions of said side walls extend beneath the water surface on either side of the propeller to act as steering fins while said roof portion rides clear of the water.

8. In a marine craft of the shaft and pitched propeller type, where a propeller has only one degree of freedom characterized by a rotating movement around the propeller shaft, a marine drive apparatus for steering said marine craft and reversing its motion through the water, said apparatus comprising:

two spaced side walls;

a roof portion rigidly joining said spaced side walls to form a shroud channel;

means for mounting said shroud channel to said marine craft;

said means including a first means for selectively rotating said shroud channel around a first substantially vertical axis in order to direct the flow of water produced by said propeller and thus steer said marine craft; and said means including a second means for tilting said shroud channel around a second substantially horizontal axis such that said roof portion of said shroud channel is aft of said propeller in order to intercept and deflect the flow of water produced by said propeller and thus create reverse thrust.

9. A marine drive apparatus according to claim 8 wherein said roof portion includes inwardly directed deflection means located at least at its aft end for providing increased reverse thrust.

10. A marine drive apparatus according to claim 9 wherein said deflection means comprises a pair of vanes respectively located at the forward and aft ends of said roof portion.

11. A marine drive apparatus according to claim 8 wherein said first axis is defined by a cylindrical rudder post rotatably mounted to a coaxial bearing adapted for rigid attachment to a marine craft.

12. A marine drive apparatus according to claim 11 wherein rotation about said second axis is achieved by an hydraulically actuatable piston coaxial with said rudder post.

13. A marine drive apparatus according to claim 12 wherein said piston connects with a transverse cross bar pivotably connected at its opposite ends with respective links in turn pivotably connected at their opposite ends to coaxial pivot points on said channel spaced from said second axis.

14. A marine drive apparatus according to claim 8 wherein said first and second axes do not intersect.

15. A marine drive apparatus according to caim 8 wherein said first axis is vertical.

16. A marine drive apparatus according to claim 8 wherein said challe is substantially U-shaped in cross-section and positioned such that in its forward configuration the lower portions of said side walls extend beneath the water surface on either side of the propeller to act as steering fins while said roof portion rides clear of the water.

17. According to the invention there is provided a marine drive apparatus including a reversing and steering channel at least partly shrouding a rotatable propeller so as to direct the flow of water produced by said propeller, said channel in its forward configuration having spaced side walls joined by a roof portion and being selectively rotatable about a first substantially vertical axis to provide steerage and a second substantially horizontal axis to move said roof portion aft of said propeller such that said channel can intercept and deflect said flow, thereby to provide reverse thrust, said channel being substantially U-shaped in cross-section and positioned such that in its forward configuration a lower portions of said side walls extend beneath the surface of said water on either side of the propeller to act as steering fins while said roof portion rides clear of said water.

18. A marine drive apparatus according to claim 17 wherein said roof portion includes inwardly directed deflection means located at least at its aft end for providing increased reverse thrust.

19. A marine drive apparatus according to claim 18 wherein said deflection means comprises a pair of vanes respectively located at the forward and aft ends of said roof portion.

20. A marine drive apparatus according to claim 18 wherein said first axis is defined by a cylindrical rudder post rotatably mounted to a coaxial bearing adapted for rigid attachment to a watercraft.

* * * * *